United States Patent [19]

Stetter

[11] Patent Number: 4,634,340

[45] Date of Patent: Jan. 6, 1987

[54] EQUIPMENT FOR CONTROLLING THE EXTRACTION PRESSURE OF AN EXTRACTION CONDENSING TURBINE

[75] Inventor: Heinz Stetter, Nuremberg, Fed. Rep. of Germany

[73] Assignee: Alsthom-Atlantique, Paris, France

[21] Appl. No.: 756,216

[22] Filed: Jul. 18, 1985

[30] Foreign Application Priority Data

Jul. 26, 1984 [DE] Fed. Rep. of Germany ..... 3427528

[51] Int. Cl.[4] ..... F01D 17/08

[52] U.S. Cl. ..... 415/95; 415/115; 415/150; 415/161

[58] Field of Search ..... 415/48, 49, 94, 95, 415/144, 145, 115, 116, 148, 150, 151, 161

[56] References Cited

U.S. PATENT DOCUMENTS

| | | | |
|---|---|---|---|
| 2,380,237 | 7/1945 | Harris | 415/95 |
| 2,948,460 | 8/1960 | Zeman | 415/150 |
| 4,053,256 | 10/1977 | Hertel | 415/161 |
| 4,220,008 | 9/1980 | Wilber et al. | 415/150 X |
| 4,349,312 | 9/1982 | Stieger | 415/145 |

FOREIGN PATENT DOCUMENTS

| | | | |
|---|---|---|---|
| 2513581 | 9/1976 | Fed. Rep. of Germany | 415/161 |

*Primary Examiner*—Robert E. Garrett
*Assistant Examiner*—Joseph M. Pitko
*Attorney, Agent, or Firm*—Sughrue, Mion, Zinn, Macpeak, and Seas

[57] ABSTRACT

This invention relates to a device for controlling the extraction pressure of an extraction condensing turbine with pivotable vanes or vane parts of guide vane lattices arranged downstream of the steam extraction point(s) where the pivoting motion of the vanes is effected by means of adjusting levers or arms by axial displacement of adjusting rings forming the bearings said adjusting levers or arms. According to the invention, the adjusting rings (15) are solidly connected to annular pistons (11, 12) which are axially slidably supported in the annular space (6) of an annular casing (7, 9, 10) arranged coaxially to and surrounding the rotor shaft (4) on one or a plurality of coaxial rods (13) or similar guiding means and which are provided with seal strips (14) on their radially outer and radially inner peripheral surfaces; furthermore, the pressure spaces **(23*a*, 23*b*) of the two annular pistons (11, 12) are supplyable via pipes (21, 22) with the turbine's own steam at a correspondingly high pressure whereas the suction space or, respectively, each suction space communicates through corresponding passages (24, 5, 29) with the low-pressure spaces downstream of the guide vanes (18)**.

2 Claims, 3 Drawing Figures

EQUIPMENT FOR CONTROLLING THE EXTRACTION PRESSURE OF AN EXTRACTION CONDENSING TURBINE

FIELD OF THE INVENTION

This invention relates to equipment for controlling the extraction pressure of an extraction (pass-out) condensing turbine where steam for heating purposes or chemical process purposes is extracted from a stage in the blade channel of the intermediate-pressure section or high-pressure section and where the steam remaining in the turbine is made to flow into a two-flow low-pressure section with pivotable vanes or vane parts of guide vane lattices arranged downstream of the steam extraction point (s), the pivoting motion of the blades or vanes being effected via adjusting levers or arms by the axial displacement of adjusting rings forming the bearings of the adjusting levers or arms.

BACKGROUND OF THE INVENTION

In order to maintain, or even increase, the pressure at increased extraction rates, it has been known, for instance, to install butterfly valves designed to be controllable accordingly in the crossovers between the intermediate-pressure and low-pressure sections. A drawback has been in the fact that throttling by the valves is associated with a loss of pressure drop which involves a loss of electrical output.

In order to avoid the aforementioned drawback it has been known in district-heating power stations to provide pivotable guide vanes downstream of the steam extraction point and arrange to be pivoted by means of a device—such a control device was disclosed, for instance, by the German Preliminary Pat. No. 25 13 581, but there were no definite instructions in that disclosure regarding the means for the axial displacement of the adjusting ring connected to the adjusting arms.

As far as the applicant is aware of, the practical realization of adjustable guide vanes in large extraction (pass-out) condensing turbines failed because the adjusting devices in the interior of multi-casing turbines proved to be too complicated and mostly relied on oil-hydraulic actuating means. However, the use of oil is problematic because, in view of the fire risk, the oil has to be kept away from the hot steam.

The present invention has for its object to simplify a device of the type initially referred to in a manner that it can be applied primarily as an internal control device; furthermore, a fluid power type actuator is proposed to be used whose pressure fluid is well compatible with the working fluid used in the turbine.

SUMMARY OF THE INVENTION

According to the present invention, this object is achieved by the features covered by claim 1 hereof.

As a further development of the invention where two extraction steam flows of different pressures are taken off for heating or chemical process purposes, a solid and axially immovable partition is proposed to be provided between the two annular pistons and a labyrinth seal is provided in the radial clearance communicating with the spaces of low pressure downstream of the adjustable guide vanes between the radially inner ring casing wall and the rotor shaft in the area of the ports connecting the suction space of each annular piston with the radial clearance.

Two typical examples of the internal controlling device according to the invention are schematically shown in the accompanying drawing:

DESCRIPTION OF PREFERRED EMBODIMENT

Figure 1:
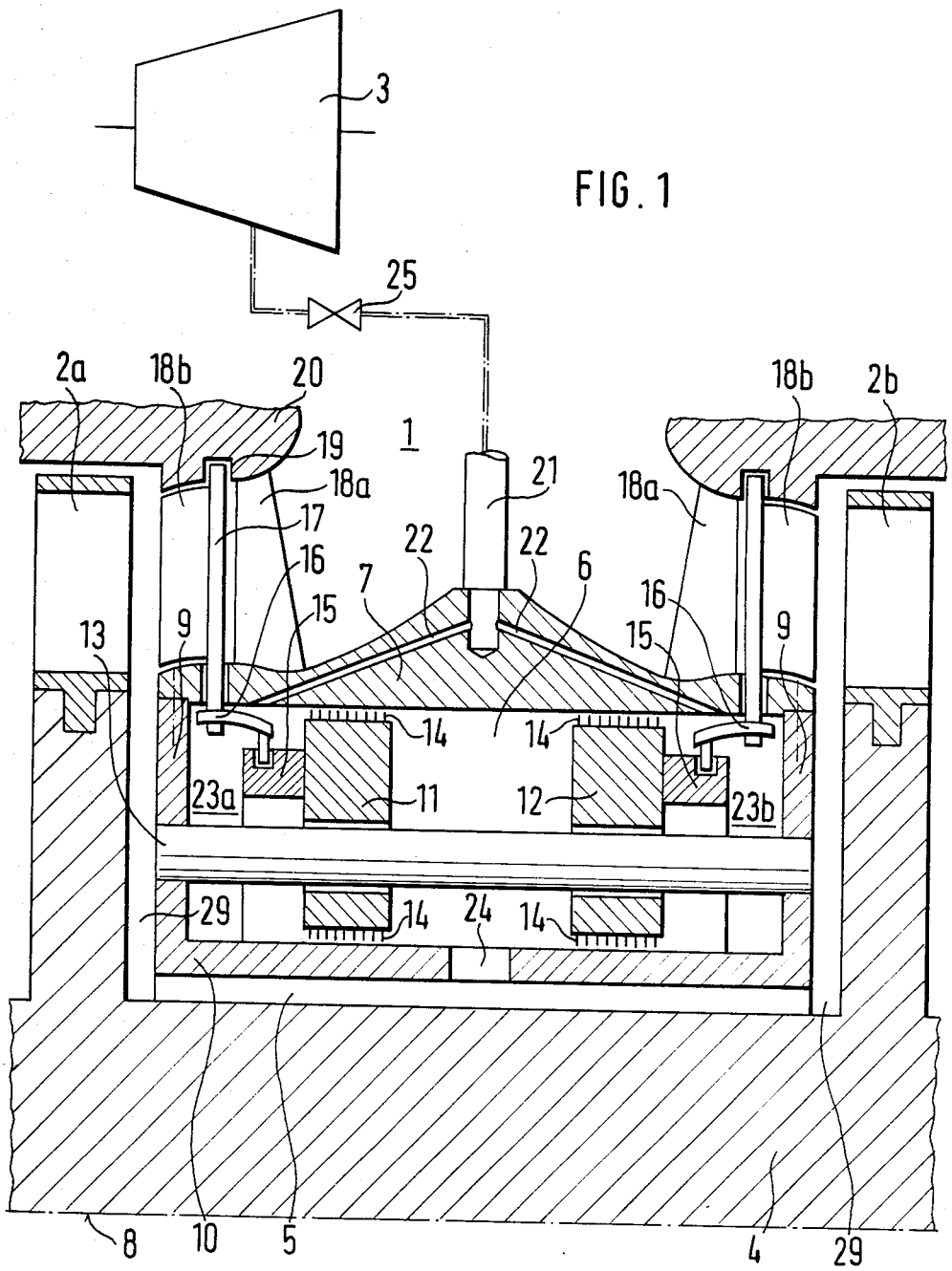
FIG. 1 shows the upper half of a longitudinal centre section through the inlet part of a double-flow symmetrical low-pressure turbine, FIG. 2 a controlling device usable for two steam extractions, the adjustable guide vanes, the adjusting levers and the adjusting rings being omitted, and FIG. 3 a variant of an adjustable guide vane in cross-section.

The adjusting device is substantially arranged in the ring space 1—i.e. a space which already exists—between the two first blade wheels *2a, 2b* of a double-flow low-pressure turbine which, in respect of the turbine stages, is symmetrical. The low-pressure turbine is preferably part of a heating-steam extraction turbine, the extraction of the heating steam taking place at the outlet of the intermediate-pressure section 3 where the steam flow which, downstream of the extraction point, remains in the turbine is passed through a cross-over from the intermediate-pressure turbine outlet into the ring space 1 without any throttling action.

The adjusting device is formed with an annular casing situated in the turbine interior and arranged coaxially to the rotor shaft 4 and surrounding the latter with a clearance (radial clearance 5), said annular casing consisting of a radially outer shell 7, two annular discs 9 extending perpendicular to the longitudinal centre line 8 of the rotor and a radially inner shell 10. Arranged in the ring space 6 of the annular casing, there are two annular pistons 11, 12 which are axially slidably supported on one or a plurality (preferably a plurality in order to obtain stable guidance of the annular pistons) of coaxial guide rods 13. On their radially outer and radially inner peripheral surfaces the annular pistons 11, 12 are provided with seal strips 14 which form labyrinth seals in the radial clearances between the annular pistons 11, 12 and the outer and inner peripheral surfaces of the annular pistons, slight leakage flows through the labyrinth seals maintaining a pressure difference across the annular pistons 11, 12. Firmly connected to the annular pistons 11, 12 on each side facing the blade wheels 2 is an adjusting ring 15. Adjusting levers 16 bear on the adjusting rings 15; the other end of each adjusting lever 16 is solidly connected to the radially inner end of a radially extending shaft 17. The shafts 17 penetrate through the length of their allied guide vanes and are solidly connected to the guide vane or part thereof and rotatably supported and guided with their radially outer ends in recesses 19 in the inlet casing 20 or a guide vane ring. Rotation of the guide vanes 18 or guide vane parts is by the axial displacement of the annular pistons 11, 12 whereby in a manner known per se a pivoting motion of the adjusting levers 16 is produced and, as a result, a rotary motion of the guide vanes 18 or the rotatable parts thereof. However, there are also different configurations of the mechanical adjusting linkage 15, 16, 17.

The axial adjustment of the annular pistons 11, 12 is effected by the turbine's own steam at a sufficiently high pressure which is passed through a control pressure line 21 and drilled galleries 22 in the outer shell, or corresponding pipes, into the two pressure spaces *23a, 23b* at the ends of the annular pistons 11, 12 facing the corresponding adjusting rings 15 and adjusting levers 16. The space 6 (suction space) between the inner annular piston end faces communicates via one or a plurality of ports 24, or openings, in the inner shell with the radial clearance 5 and, consequently—as a result of the axial clearance 29—with the spaces of low pressure downstream of the guide vanes 18.

The axial displacement of the annular pistons 11, 12 has to be effected against the total of the axial steam force components acting on the adjustable guide vanes 18. Depending on the size of the pressure area of the annular pistons 11, 12, the pressure in the pressure spaces 23*a*, 23*b* has to be adjusted so as to balance the total axial force due to the axial steam force components. Since the axial force components acting on the guide vanes 18 invariably act in the opening sense, the direction of the pressure force acting on each annular piston 11, 12 is always the same. In order to have the necessary pressure available in the pressure spaces 23*a*, 23*b*, there is a pressure setting valve 25 provided in the control pressure pipe 21 outside the turbine casing which preferably communicates with a higher-pressure turbine bleed point for regenerative feed heating. Control of the setting valve 25 is provided on the lines of the conventional control of the (external) butterfly valve in the cross-over so that this detail need not be discussed any further.

Figure 3:
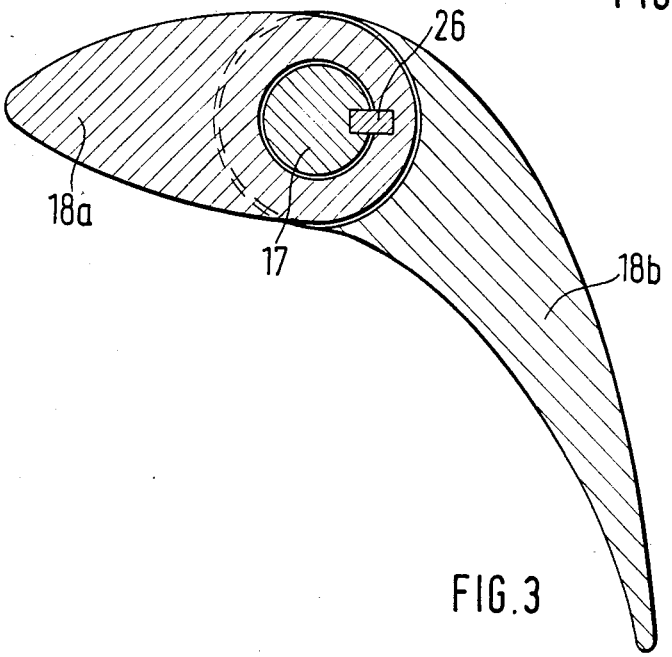

It is not necessary to pivot the complete guide vane 18. Each guide vane 18 may be formed with a fixed front part 18*a*, the pivot shaft 17 and an adjustable (pivotable) part 18*b* (FIG. 3). The fixed parts 18*a* carry the adjusting mechanism and connect them to the inlet casing part of the low-pressure turbine. The adjustable parts 18*b* serve to control the steam extraction pressure by varying the flow area of the first two guide vane lattices 18.

The shaft 17 may—cf. FIG. 1—be an integral part of the adjustable part 18*b*; but it may also—cf. FIG. 3—be threaded through corresponding recesses of the parts 18*a*, 18*b* and connected to the adjustable part 18*b* by a conventional keyed joint 26 which enables a torque to be transmitted by friction grip and form closure.

The axial displacement path of the annular pistons may be limited by stops.

Compression springs—these are not shown in the drawing—may be arranged between the annular pistons 11, 12 for reliable opening of the guide vanes 18.

Figure 2:
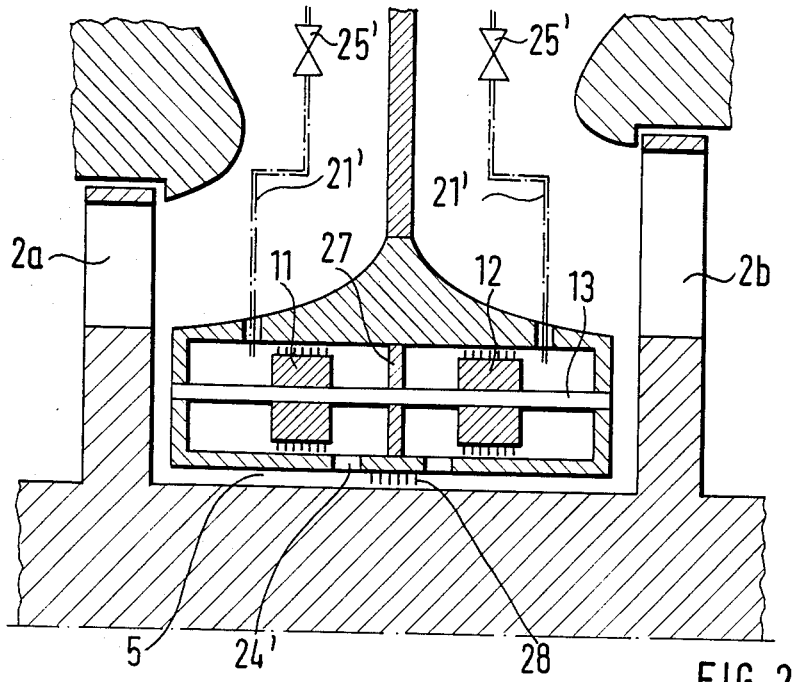

The above described apparatus may be extended by simple means to permit two extraction pressures to be controlled for heating or process purposes (FIG. 2).

This application would involve a low pressure turbine which is non-symmetrical with respect to the number of stages and which has two separate inlet zones. The adjusting device usable for this application differs from the adjusting device according to FIG. 1 (only) in that a solid axially non-displaceable partition 27 is provided between the annular pistons 11, 12, in that each pressure stage 23*a* or 23*b* respectively is connected by a control pressure pipe 21' each and a pressure setting valve 25' each with the associated control steam source, in that each suction space communicates through a port 24' each with the radial clearance 5, and in that a shaft seal (labyrinth seal) is provided in the radial clearance 5 between the ports 24' with seal strips 28 preferably attached to the inner shell 10.

I claim:

1. Apparatus for controlling the extraction pressure of an extraction condensing turbine having an intermediate-pressure section or high-pressure section and a double-flow low-pressure section, said double-flow low-pressure section having guide vane lattices, said apparatus including means for taking steam off a stage in the blade pasage of said intermediate-pressure section or the high-pressure section of said turbine for heating purposes or chemical process purposes, means for passing the steam remaining in the turbine into said double-flow low-pressure turbine section, pivotable vanes of said guide vane lattices arranged in said double-flow, low-pressure turbine section downstream of the steam extraction point and means for effecting vane pivoting motion by adjusting levers, adjusting rings forming the bearings of the adjusting levers for axial displacement of said adjusting levers, the improvement wherein said double-flow low-pressure turbine section further comprises an annular casing (7, 9, 10) arranged coaxially to and surrounding a rotor shaft (4), annular pistons (11, 12) axially slidably supported in an annular space (6) defined by at least said annular casing (7, 9, 10), adjusting rings (15) slidably connected to said annular pistons (11, 12), said annular pistons (11, 12) being mounted on at least one coaxial rod (13), said annular pistons (11, 12) having radially outer and radially inner peripheral surfaces, seal strips (14) provided on said radially outer and radially inner peripheral surfaces, means defining pressure spaces, respectively, (23*a*, 23*b*) for said two annular pistons (11, 12), means including pipes (21, 22) for supplying said pressure spaces (23*a*, 23*b*) with turbine steam from said intermediate-pressure section or said high-pressure section at a correspondingly high pressure, means forming low-pressure spaces downstream of the guide vanes (18), means defining at least one suction space, and means for communicating via connections (24, 5, 29), said at least one suction space with the low-pressure spaces downstream of the guide vanes (18), and a pressure setting valve (25) arranged in said control pressure pipe (21), and the actuating and control mechanism for said setting valve and said means for effecting vane pivoting motion constituting the guide vane adjusting apparatus being arranged in the annular space (1) between the two first moving blade lattices (2*a*, 2*b*) of the low-pressure turbine section.

2. Apparatus as claimed in claim 1, further comprising a solid axially non-displaceable partition 27 provided between said two annular pistons (11, 12), and wherein a labyrinth seal (28) is provided in a radial clearance (5) communicating with the spaces of low pressure downstream of the adjustable guide vanes (18) between the radially inner annular casing wall (10) and the rotor shaft (4), and wherein two ports (24') connect the suction space of each annular piston (11, 12) with the radial clearance (5).

* * * * *